United States Patent [19]

Walling

[11] 4,206,790

[45] Jun. 10, 1980

[54] POWDER EJECTION NOZZLE FOR STRANDER

[75] Inventor: Jörg-Hein Walling, St. Hubert, Canada

[73] Assignee: Northern Telecom Limited, Montreal, Canada

[21] Appl. No.: 902,158

[22] Filed: May 2, 1978

[51] Int. Cl.[2] ..... H01B 13/06

[52] U.S. Cl. ..... 141/250; 174/23 C; 57/7; 366/191

[58] Field of Search ..... 141/250, 290; 174/23 R, 174/23 C, 102 P, 118; 156/48; 57/7, 8; 222/413, 252, 410, 202, 195; 366/155, 191, 156, 102, 325; 198/642, 638

[56] References Cited

U.S. PATENT DOCUMENTS

| | | | |
|---|---|---|---|
| 1,677,119 | 7/1928 | Kinyon | 366/191 |
| 1,753,050 | 4/1930 | Hughes | 366/102 |
| 2,424,507 | 9/1946 | Powell et al. | 57/7 |
| 3,538,235 | 11/1970 | Arendt et al. | 174/23 C |

*Primary Examiner*—Willis Little

[57] ABSTRACT

A device for filling the interstices of a multi-stranded cable with powder, comprising an outer tubular housing and a concentric inner tube with an annular chamber therebetween for moving powder filler from an inlet to the outlet end of the device. Air is deliverable under pressure to the outlet end of the device to disperse the powder as a cloud.

14 Claims, 6 Drawing Figures

POWDER EJECTION NOZZLE FOR STRANDER

This invention relates to the production of multi-stranded electrical cables and more particularly to filling the interstices of such cables.

Multi-stranded electrical cables are filled with powder for water blockage. A powder filling for this purpose is described in U.S. Pat. No. 4,002,819 issued Jan. 11, 1977 to Northern Telecom Limited assignee of Leo V. Woytiuk. One method of filling the interstices of the cable is by passing the cable core through an electrostatic powder chamber as described in United States Patent Application Ser. No. 564,070 filed Apr. 1, 1975 in the name of Leo V. Woytiuk assignor to Northern Telecom Limited. Such a method is relatively difficult to operate in order to obtain fine adjustments in the amount of powder filling placed within the interstices of the cable, i.e. to regulate accurately the percentage of voids filled by the powder.

It is an object of the present invention to provide an improved method and apparatus for powder filling a multi-stranded cable.

Essentially the invention consists of a device for use in apparatus for filling the interstices of a multi-stranded cable with powder in which a plurality of strands are fed into a closing die having an outwardly flaring inlet wall, comprising: an outer tubular housing having a free end and; an inner tube having a free end and being concentric with the housing, the inner tube being spaced therefrom to form with the housing an annular chamber having an inlet for receiving powder and an outlet end; means to move powder along the chamber to the outlet end thereof; and means to deliver air under pressure to the outlet end of the chamber whereby powder moved along the chamber is dispersed as a cloud from the outlet end thereof said air delivery means comprising longitudinal passage means located within the outer housing, the outlet end of the chamber being locatable within the inlet wall of the closing die and spaced thereform.

Example embodiments of the invention are shown in the accompanying drawings in which.

Figure 1:
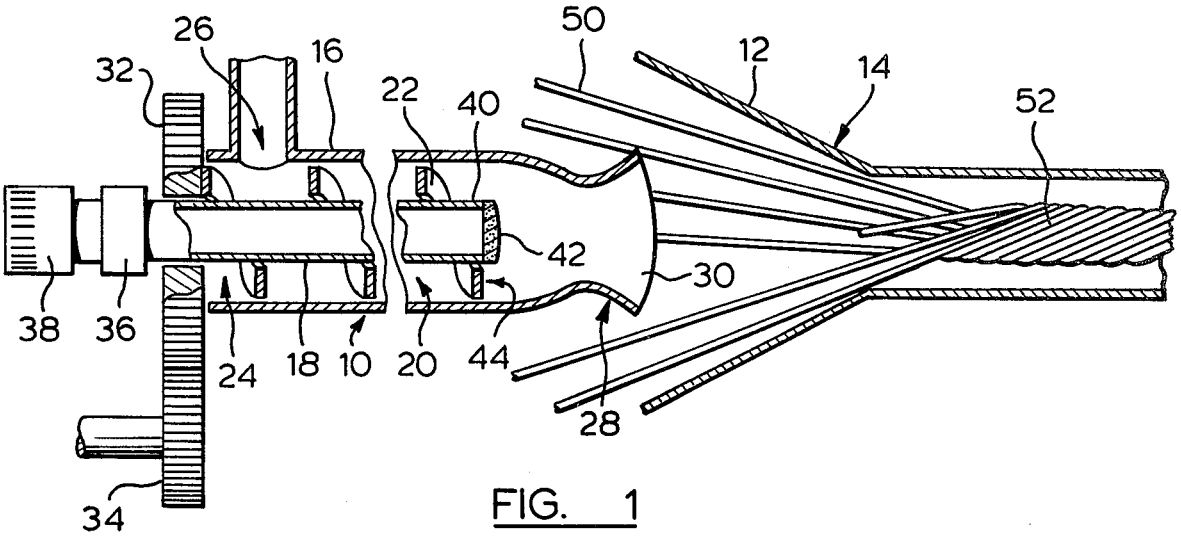
FIG. 1 is a side view in cross-section of a device for powder filling a cable, in association with a closing die.

The example embodiment shown in Figure of the drawings consists of a cable filling device in the form of a powder distributor 10 locatable at the outwardly flaring inlet wall 12 of a closing die 14. Distributor 10 comprises an outer tubular housing 16 and a concentric inner tube 18, the tube and the housing forming between them an annular chamber 20. A rotatable helical screw member 22 concentric with tube 18 is located in chamber 20. That end of chamber 20 remote from closing die 14, designated as inlet end 24, has a powder feed aperture 26 opening laterally into the chamber. Outlet end 28 of housing 16, which in the operation of the device is located within inlet wall 12 of closing die 14, flares outwardly to form a bell mouth 30.

Adjacent inlet end 24 of distributor 10 lies a gear 32 coaxial with housing 16 and meshing with a drive gear 34. helical screw 22 is fixed at one end to gear 32. In this embodiment gear 32 serves to close inlet end 24 of housing 16 and chamber 20. Inner tube 18 extends through gear 32 and connects with a compressor 36 driven by a direct current motor 38.

The free end 40 of inner tube 18 terminates inwardly from mouth 30 of outlet end 28 of outer housing 16 and is closed by a cap 42 of porous material. Helical screw 22 terminates adjacent free end 40 of inner tube 18. The outlet end of chamber 20, remote from inlet end 24, is designated by numeral 44.

In the operation of the device of FIG. 1 conductors, pairs or quads 50 are fed from a strander (not shown) into closing die 14 through its inlet 12 to form a stranded cable 52. Distributor 10 is located within the circle of conductors 50 as they enter closing die 14 and is aligned coaxially with the closing die. As conductors 50 are fed into closing die 14, powder is fed continuously through inlet 26 into chamber 20 and gear 32 is rotated by drive gear 34 which rotates helical screw 22 to carry the powder forward in the annular chamber towards outlet end 28 of housing 16. At the same time air under pressure is forced along inner tube 18 from compressor 36 and through porous cap 42. As the powder in chamber 20 is forced past the free end of inner tube 18 by helical screw 22 it is propelled forwardly by the air from inner tube 18 through mouth 30 of outer housing 16 into closing die 14. The shape of bell mouth 30 also disperses the powder laterally. As conductors 50 close to form stranded cable 52 the powder entering closing die 14 is carried by the conductors to fill the interstices in the cable. Preferably conductors 50 are coated with oil to which the powder adheres.

Figure 2:
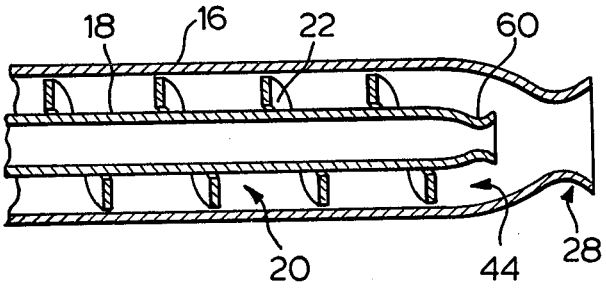
FIG. 2 is a cross-sectional side view of an alternate embodiment of the device of FIG. 1.

The device of FIG. 2 is an alternate embodiment of the device of FIG. 1 and it is employed in the same manner to powder fill a stranded cable. In this alternate embodiment inner tube 18 terminates in a lavel nozzle 60 for the air pressure supply.

Figure 3:
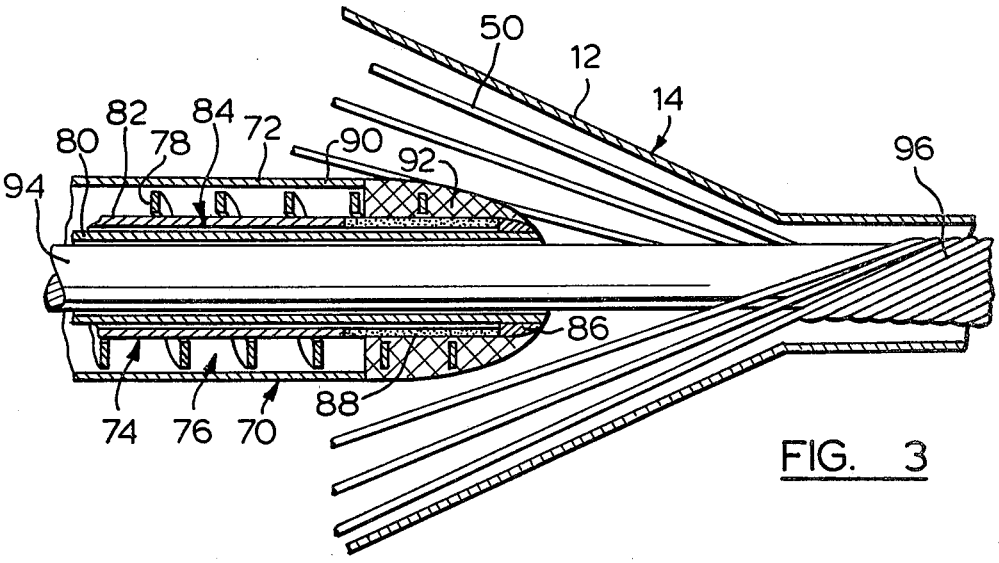
FIG. 3 is a cross-sectional side view of an alternate embodiment of the device of FIG. 1 for producing a multi-stranded cable having a core.

The alternate embodiment of the device shown in FIG. 3 of the drawings is for use in powder filling a multi-stranded cable having a core. In this example embodiment a distributor 70 comprises an outer tubular housing 72 and a concentric inner tube 74, the tube and housing forming between them an annular chamber 76. A rotatable helical screw member 78 concentric with tube 74 is located in chamber 76. Inner tube 74 is divided into an inner tubular cylinder 80 and an outer tubular cylinder 82 separated from the inner cylinder to form longitudinal passageways 84. Adjacent its free end 86 closing passageways 84, outer tubular cylinder 82 has a circumferential porous cap 88. Inner tube 74 projects beyond the end 90 of outer housing 72 and circumscribing screen 92 joins the end of the outer housing and end 86 of cylinder 84.

The operation of the device of FIG. 3 is similar to that of FIG. 1 with conductors 50 fed into closing die 14 and with distributor 70 located within the circle of the conductors. As conductors 50 are fed into closing die 14 from a strander, a core 94 is simultaneously fed axially into the closing die through inner tube 74 of distributor 10, and the conductors are wrapped around the core to form a cable 96. At the same time powder is fed along chamber 76 by helical screw 78 and air under pressure is forced along passageways 84 of inner tube 74. The air from passageways 84 passes through porous cap 88 of outer tubular cylinder 82 and directs the powder as a cloud into inlet wall 12 of closing die 14 where it is carried by conductors 50 to fill the interstices between the conductors as they are wrapped about core 94. Screen 92 assists in breaking up any agglomerations of the powder being moved by helical screw 76.

Figure 4:
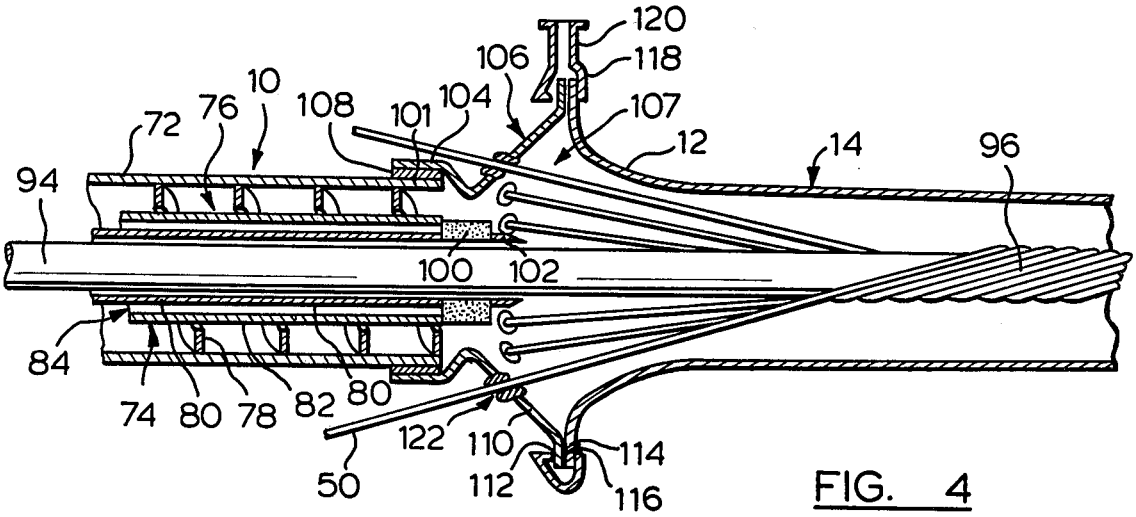
FIG. 4 is a cross-sectional side view of a further alternate embodiment of the device of FIG. 1 associated with an auxiliary device for receiving excess powder.

The alternate embodiment shown in FIG. 4 of the drawings is similar to the device shown in FIG. 3 in producing a cored cable 96. Again inner tube 74 has longitudinal passageways 84 terminating in a cylindrical porous cap 100 located beyond the end of inner tube 74 which is coterminus with the end 101 outer housing 72. Porous cap 100 may be set in an extension 102 of inner tubular cylinder 80 of inner tube 74. Outer housing 72 terminates within a cylindrical flange 104 integral with the apex of an axially rotatable conical shroud 106, with a ring bearing seal 108 between the housing and the flanges. Shroud 106 has a conical main body section 110 and a circular inner flange 112 located close to the free, outward flaring edge 114 of inlet wall 10 of closing die 14 with a gap 116 therebetween. Distributor 10, shroud 106 and inlet 12 of closing die 14 to form a cloud chamber 107. A channel 118 circumscribes flange 112 and edge 114 with an outlet circuit 120 connectable to suction means not shown. Strands 50 pass through spaced apertures 122 in main body section 110 of shroud 106.

The operation of the device of FIG. 4 is similar to that of FIG. 3. Core 94 is fed through inner tube 74 of distributor 10 into closing die 14, conductors 50 are fed through shroud 106 into the closing die, powder is fed along chamber 76 by helical screw 78, and air under pressure is forced along passageways 84 of the inner tube. The pressurized air, forced through porous cap 100, disperses the powder emanating from chamber 76 into cloud chamber 107 where it is carried by conductors 50 to fill the interstices between the conductors as they are wrapped around core 94. As conductors 50 pass continuously into closing die 14 shroud 106 rotates about its conical axis and excess powder is drawn by suction through gap 116 into conduit 120 for recycling.

Figure 5:
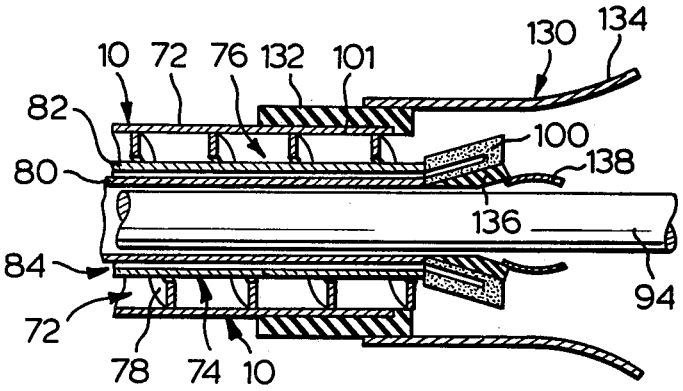
FIGS. 5 and 6 are cross-sectional side views of further embodiments of the device of FIG. 1.

In FIG. 5 an alternate embodiment of the invention is shown for use in the electrostatic disposition of powder on conductors 50 for filling the interstices of a multistranded cable. As in the embodiment of FIG. 3, distributor 10 includes an inner tube 74 having passageways 84 terminating in a porous cap 100 located at the end of the inner tube which is approximately coterminous with the end 101 of outer housing 72. A cylindrical ejection nozzle 130 is fixed at one end 132 to the free end 101 of outer housing 72 by a collar 132 of high voltage insulation material. The free end 134 of nozzle 130 flares outwardly. A ring 136 of high voltage insulation material is located concentrically within porous cap 100 and carries a cylindrical deflector guard 138 at its free end.

In the operation of the device of FIG. 5 powder is electrostatically charged such as by passing it through an electrostatic chamber as described in above-mentioned U.S. Application Ser. No. 564,070. The charged powder is then fed along chamber 76 of distributor 10 by screw 78 while pressurized air is forced through porous cap 100 to distribute the powder as a cloud through nozzle 130 onto conductors 50 passing into closing die 14 as in FIG. 1, 3 or 4.

Figure 6:
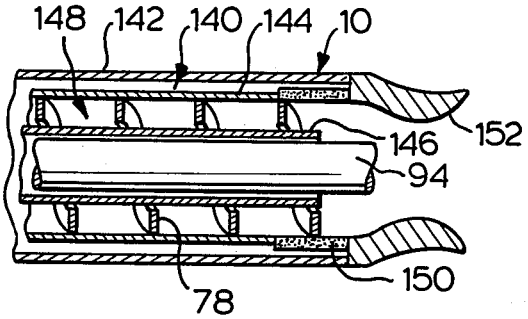

FIG. 6 of the drawings shows an alternate embodiment of the invention in which on annular passage 140 for pressurized air is located between an outer housing 142 and a concentric tube 144 within the outer housing and defining, with an inner tube 146, a chamber 148 in which helical screw 78 is located. Tube 144 terminates in a cylindrical porous section 150 which projects beyond the free end of inner tube 146. Outer housing 142 terminates in a contoured nozzle 152 which seals the end of annular passage 140.

The embodiment of FIG. 6 operates in the same manner as the previous embodiments with powder being pushed through annular chamber 148 and dispersed through nozzle 152 by pressurized air emanating from passage 140 through porous section 150, nozzle 152 being located in inlet 12 of closing die 14 as in FIG. 1, 3 or 4.

It will be appreciated that the present invention provides a device which improves the accuracy of controlling the amount of powder filler used in the continuous production of a multi-stranded cable, including such a cable having a core, and the proper dispersement of the powder among the strands. The amount of powder dispersed by distributor 10 is governed by the input into aperture 26 and the speed of revolution of helical screw 22 or 78 (which also provides equal distribution circumferentially at the outlet end of chamber 20, 76 or 148). The pressurized air flow can be used to monitor the proper concentration of powder emanating from the device. Thus a decrease in the air flow would indicate that the concentration of powder is too high and conversely if the concentration of powder decreases the air flow will increase. By suitable feedback from DC motor 38 the feeding rate of powder can be controlled with a very short time lag.

The recovery of excess powder shown in the auxiliary device of FIG. 4 (shroud 106) may be used in the other embodiments with suitable structural modifications. Similarly screen 92 shown in FIG. 3, of suitable mesh size, may be used in other embodiments.

In addition to, or in substitution for, the use of electrostatic powder, as envisaged in the embodiment of FIG. 5, strands 50 may be oil coated as a preferred method of powder filling by adherance of the powder to the strands.

The porous cap (42, 88, 100 or 150) is a preferred embodiment which inhibits blockage of the pressurized air tube (18) or passageways (84, 140) by the powder issuing from distributor 10. Depending upon the configuration of the porous cap (42, 88, 100 or 150), or nozzle 60 of inner tube 18 where no cap is used as in FIG. 2, the powder issues from distributor 10 both axially and radially as a cloud approaching uniform density.

Distributor 10 may be rigid or it may be flexible as disclosed in U.S. Patent Application Ser. No. 876,874 filed Feb. 13, 1978 in the name of J. H. Walling.

I claim:

1. In apparatus for filling the interstices of a multistranded cable with powder in which a plurality of strands are fed into a closing die having an outwardly flaring inlet wall, a device comprising:

an outer tubular housing having a free end;

an inner tube having a free end and being concentric with the housing, the inner tube being spaced therefrom to form with the housing an annular chamber having an inlet for receiving powder and an outlet end;

means to move powder along the chamber to the outlet end thereof; and means to deliver air under pressure to the outlet end of the chamber whereby powder moved along the chamber is dispersed as a cloud from the outlet end thereof, said air delivery means comprising longitudinal passage means located within the outer housing, the outlet end of the chamber being locatable within the inlet wall of the closing die and spaced therefrom.

2. A device as claimed in claim 1 in which the inner tube comprises the air delivery means.

3. A device as claimed in claim 2 including a porous cap closing the free end of the inner tube, the pressurized air passing therethrough.

4. A device as claimed in claim 2 in which the free end of the housing extends beyond the free end of the inner tube and is configured to form a nozzle.

5. A device as claimed in claim 2 in which the free end of the outer housing extends beyond the free end of the inner tube, the free end of the inner tube and the free end of the outer housing each being configured to form a nozzle.

6. A device as claimed in claim 1 in which the inner tube comprises a passage for a core on which the strands are would to form the cable.

7. A device as claimed in claim 6 in which the longitudinal passage means is located in the wall of the inner tube, the passage means terminating in a porous cap for passing pressurized air therethrough.

8. A device as claimed in claim 7 in which the free end of the inner tube extends beyond the free end of the outer housing, the porous cap being annular and circumscribing the inner tube whereby the pressurized air passes laterally therethrough with respect to the axis of the inner tube.

9. A device as claimed in claim 8 including a screen circumscribing the porous cap and spaced therefrom.

10. A device as claimed in claim 7 in which the free end of the outer housing carries a cylindrical ejection nozzle fixed thereto by a collar of high voltage insulation material, and a ring of high voltage material is fixed concentrically within the porous cap.

11. A device as claimed in claim 6 in which the longitudinal passage means is located in the wall of the outer housing, the free end of the outer housing extending beyond the free end of the inner tube, the passage means terminating in an annular porous cap concentric with the outer tube whereby the pressurized air passes laterally therethrough with respect to the axis of the outer tube.

12. A device as claimed in claim 1 in combination with said closing die having an outwardly flaring inlet wall, the device being axially aligned with the closing die, an axially rotatable conical shroud interconnecting the free end of the outer housing of the device and the inlet wall of the closing die, and a plurality of spaced apertures in the shroud for passage of strands therethrough into the closing die to form the cable.

13. A device as claimed in claim 12 in which the shroud is freely rotatable by the passage of said strands.

14. A device as claimed in claim 12 in which the shroud has a first cylindrical flange at the apex thereof interengaging the free end of the outer housing of the device through a bearing seal and a circular rim flange located adjacent the inlet end of the closing die with a gap therebetween, and suction means circumscribing the gap.

* * * * *